US006257583B1

(12) United States Patent
Roberson

(10) Patent No.: US 6,257,583 B1
(45) Date of Patent: Jul. 10, 2001

(54) REACTION SHOOTING TARGET

(76) Inventor: Michael Lee Roberson, 808 N. Birch, Jenks, OK (US) 74037

( * ) Notice: Subject to any disclaimer, the term of this patent is extended or adjusted under 35 U.S.C. 154(b) by 0 days.

(21) Appl. No.: 09/610,732

(22) Filed: Jul. 6, 2000

(51) Int. Cl.[7] ..... F41J 7/04

(52) U.S. Cl. ..... 273/390; 273/391; 273/378; 273/407; 434/19

(58) Field of Search ..... 273/390, 391, 273/378, 386, 403, 404, 406, 407, 408, 348, 127 R, 127 A, 127 B, 127 C, 127 D; 434/11, 16, 19

(56) References Cited

U.S. PATENT DOCUMENTS

| | | | | |
|---|---|---|---|---|
| 3,635,476 | * | 1/1972 | Breslow et al. | 273/127 D X |
| 3,914,879 | * | 10/1975 | Taylor, III et al. | 273/391 |
| 4,340,370 | | 7/1982 | Marshall et al. . | |
| 4,373,733 | | 2/1983 | Smith, Jr. . | |
| 4,548,414 | | 10/1985 | Denis . | |
| 4,588,194 | * | 5/1986 | Steidle et al. | 273/391 |
| 4,934,937 | | 6/1990 | Judd . | |
| 4,949,980 | * | 8/1990 | Hoy | 273/391 |
| 5,263,721 | * | 11/1993 | Lowrance | 273/390 |
| 5,263,722 | * | 11/1993 | Rosellen | 273/391 |
| 5,288,275 | * | 2/1994 | St. Peter | 273/127 D X |
| 5,324,043 | * | 6/1994 | Estrella | 273/391 X |
| 5,346,226 | * | 9/1994 | Block | 273/407 X |
| 5,599,187 | * | 2/1997 | Mesiano | 434/19 |
| 5,603,505 | | 2/1997 | Acock . | |
| 5,676,378 | | 10/1997 | West . | |
| 5,865,439 | | 2/1999 | Marcuson, III et al. . | |

FOREIGN PATENT DOCUMENTS

| | | | | |
|---|---|---|---|---|
| 2404712 | * | 8/1975 | (DE) | 273/406 |
| 2587102 | * | 3/1987 | (FR) | 273/406 |
| 1779901 | * | 12/1992 | (SU) | 273/406 |

* cited by examiner

*Primary Examiner*—Raleigh W. Chiu
(74) *Attorney, Agent, or Firm*—Molly D. McKay

(57) ABSTRACT

An economical reaction shooting target consisting of three targets movably secured to a frame that supports the targets above the ground. Initially, a central target that stands vertically is presented to the shooter. The central target pivotally attaches to the frame so that the central target falls backward once a bullet strikes it. When the central target falls backward, ears on the central target disengage arms provided on two spring loaded side targets, allowing the side targets to swing forward and be presented to the shooter. Various images of good guys and bad guys may be randomly chosen to be attached to the side targets, requiring the shooter to quickly determine whether to shoot the images on the side targets.

4 Claims, 2 Drawing Sheets

REACTION SHOOTING TARGET

BACKGROUND OF THE INVENTION

1. Field of the Invention

The present invention relates to an economical shooting target that, when struck by a bullet will automatically release two additional targets. The two additional targets can be provided with images of bad guys or good guys in various situations so that the shooter must quickly decide whether the images presented on the targets are friendly or unfriendly, teaching the shooter how to quickly decide whether to shoot the images or not, thus simulating and allowing the officers to practice making the type of crucial real life decisions that police officer are often required to make.

2. Description of the Related Art

Law enforcement personnel, such as policemen, need to practice shooting their guns under conditions that closely approximate real life situations so that when they are called upon to make a quick decision on whether or not to shoot someone in the field, they will be able to make good decisions and will be able to make those decisions quickly. Failure of the officer to make good decisions about whether to shoot or not shoot can result in innocent people being injured or killed, and failure of the officer to make a decision quickly about whether to shoot or not to shoot can result in the officer being injured or killed.

The problem in providing all officers with this type of training is that many of the reaction shooting targets, i.e. those that require an officer to make quick decisions on whether to shoot or not are quite expensive to purchase. Small municipal police departments often can not afford to purchase these expensive shooting targets on their limited budgets. Thus, officers in smaller communities often are not adequately trained to make the most crucial decisions that they may face in their jobs.

The present invention is a reaction shooting target that is economical enough to be affordable to almost any police department and still provides officers with a tool that will allow them to practice quick decision and shooting techniques.

The present invention is a reaction shooting target that is provided with three targets: a central target that falls backward when struck by a bullet, and two targets that immediately swing forward into locked frontal positions when the central target falls backward. Various pictures of bad guys and good guys can be attached to the two swing out targets so that the shooter must quickly identify whether the images displayed on the swing out targets are friendly or unfriendly and they the shooter must shoot only the unfriendly images when the images present a situation where shooting the unfriendly image would be appropriate.

Someone must manually reset the reaction target. The images are changed each time the target is reset. This results in a random presentation of images to the shooter, forcing the shooter to look closely at each image and to make quick decision based on what the shooter sees.

SUMMARY OF THE INVENTION

The present invention is an economical reaction shooting target. A heavy frame holds the targets of the reaction shooting target upright above the ground. Three targets movably attach to the frame: a central target and two side targets. The first target is a central target that falls backward when struck by a bullet. The central target has a pair of ears attached to the bottom of it and the ears extend downward when the central target is in its vertical in use position. When the central target falls backward to its horizontal out of use position, the ears pivot upward and disengage notched arms provided on each of the two side target. Immediately upon disengagement of the arms from the ears, spring loaded mechanisms provided on the two side targets cause the side targets to swing outward until they come to rest in a forward position, i.e. the two side targets are aligned in the same plane and face the shooter. The spring-loaded mechanisms hold the two side targets in these forward positions while the shooter is shooting at the side targets. The side targets will remain in their forward positions until the reaction shooting target is manually reset.

In order to manually reset the reaction shooting target, the two side targets are swing back in a 90 degree arch from their forward positions and the central target is raised to its vertical position so that the ears reengage the notched arms, preventing the spring loaded mechanisms from pushing the side targets forward until the central target is once again struck by a bullet and thereby caused to fall backward.

At the same time that the reaction shooting target is manually reset, new pictures or images can be attached to the side targets so the next time the central target is struck by a bullet, a new set of images will be presented to the shooter by the two side targets. The images may include pictures of good guys and bad guys in various situations so that the shooter must quickly decide whether the images presented on the targets are friendly or unfriendly and whether the shooter should shoot the images or not.

DETAILED DESCRIPTION OF THE PREFERRED EMBODIMENT

REACTION SHOOTING TARGET

Figures 2, 3:
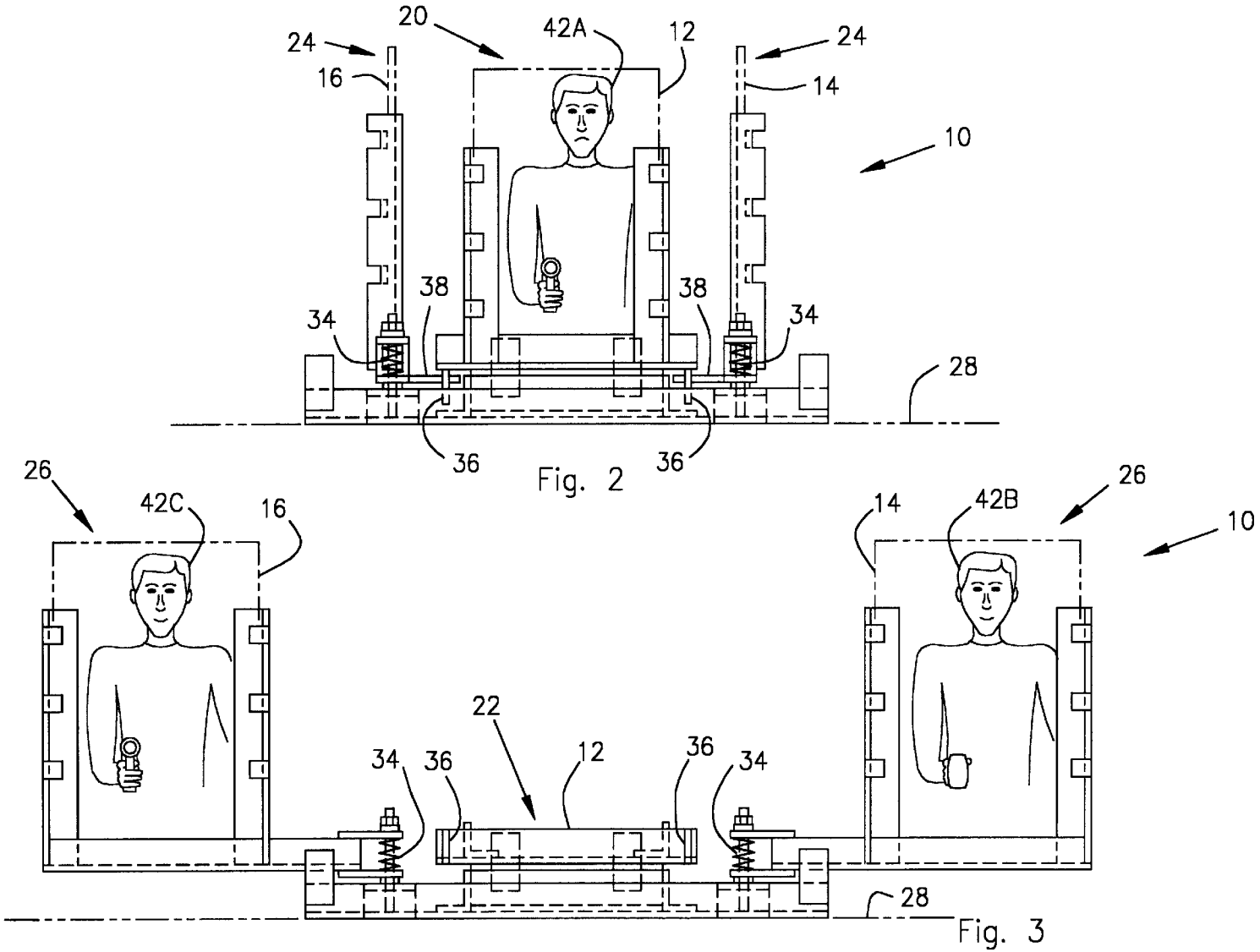
FIG. 2 is a front plan view of the reaction shooting target constructed according to a preferred embodiment of the present invention, showing the central target in its vertical position and the side targets not yet deployed.
FIG. 3 is a front plan view of the reaction shooting target of FIG. 2 showing the central target in its horizontal position after it has fallen backward upon being struck by a bullet and showing the side targets swung outward to their frontal positions.

Referring now to FIGS. 2 and 3 there is illustrated a reaction shooting target 10 constructed in accordance with a preferred embodiment of the present invention. As shown, the reaction shooting target 10 has three movable targets 12, 14, and 16 attached to a supporting frame 30. The central target 12 moves between a vertical in use position 20 and a horizontal out of use position 22, and the two side targets 14 and 16 each move between a retracted out of use position or orientation 24, i.e. approximately 90 degrees from the vertical in use position 20 of the central target 12, and a released in use position or orientation 26 where the two targets 14 and 16 are aligned in the same plane and face the shooter. The two targets 14 and 16 remain in a vertical orientation in both their retracted positions 24 and their released in use positions 26.

Figure 1:
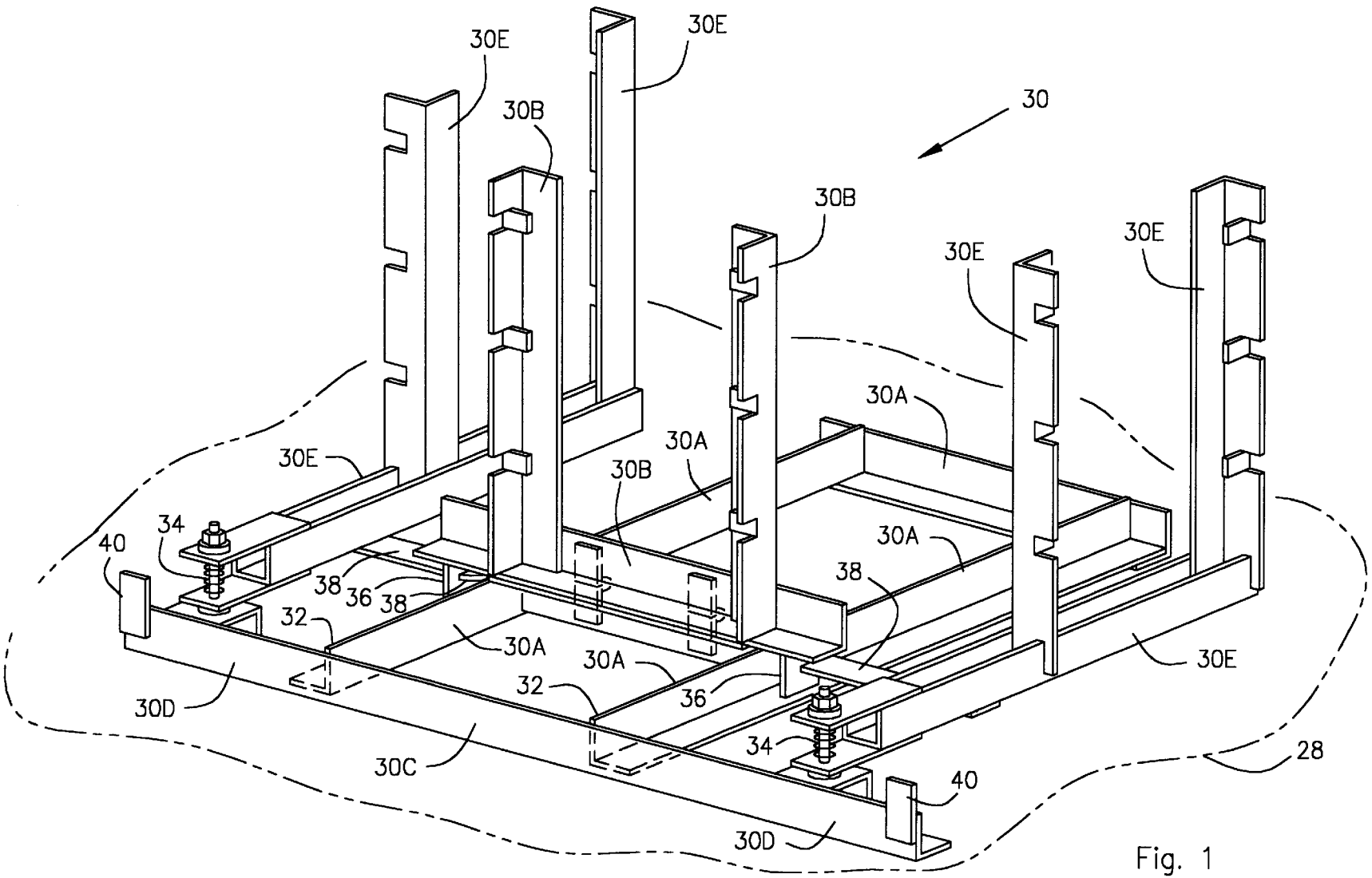
FIG. 1 is a perspective view of a frame for a reaction shooting target.

The reaction shooting target 10 is supported above the ground 28 by the heavy supporting frame 30 that is preferably constructed of metal such as angle iron or other similar material. FIG. 1 shows the reaction shooting target 10 with the three targets 12, 14, and 16, removed to show the frame 30. The frame consists of a rectangular portion 30A, a central frame portion 30B, a front portion 30C with two side extensions 30D, and two movable wing portions 30D. The rectangular portion 30A that rests on the ground 22 to form a supporting base for the reaction shooting target 10, and the central frame portion 30B pivotally attaches to the rectangular portion 30A. The central frame portion 30B supports the central target 12 that attaches to it. The central frame portion 30B pivots between its vertical position 20 and its horizontal position 22 relative to the rectangular portion 30A. The front portion 30C attaches to a front 32 of the rectangular portion 30A and extends sideways beyond the rectangular portion 30A to form two side extensions 30D, one on either side of the rectangular portion 30A. The two movable wing portions 30E movably attached to the two side extensions 30D by means of spring loaded mechanisms 34 that support the side targets 14 and 16 and bias them so that they tend to move to their released in use positions 26.

Referring now to FIGS. 2 and 3, the central target 12 attaches to the central frame portion 30B and each of the two side targets 14 and 16 attaches to a movable wing portion 30E or the frame 30. The central target 12 and the central frame portion 30B fall or pivot backward together as a unit, i.e. move from the vertical position 20 to its horizontal position 22, when the central target 12 is struck by a bullet that is fired by a shooter. The central frame portion 30B has a pair of ears 36 extending downward from a bottom 38 of the central frame portion 30B when the central target 12 is in its vertical in use position 20, as shown in FIGS. 1 and 2. Each of the ears 36 is associated with a notched arm 38 that is provided on each of the movable wing portions 30E. When the central target 12 falls backward to its horizontal out of use position 22, the ears 36 pivot upward and disengage the notched arms 38. The purpose of the notched arms 38 is to engage the ears 36 and thereby hold the movable wing portions 30E in their retracted out of use positions 24. As illustrated in FIG. 3, when the ears 36 disengage the notched arms 38, the spring loaded mechanisms 34 immediately cause the two side targets 14 and 16 and their associated movable wing portions 30E to swing outward until they come to rest in their released in use position 26. In their released in use positions 26, the side targets 14 and 16 are aligned in the same plane and face the shooter. Each of the side extensions 30D is provided with a stop 40 that engages the two movable wing portions 30E to stop and hold the side targets 14 and 16 in their released in use position 26. The spring loaded mechanisms 34 hold the two side targets 14 and 16 in their forward released in use positions 26 while the shooter is shooting at the side targets 14 and 16. The side targets 14 and 16 will remain in their forward released positions 26 until the reaction shooting target 10 is manually reset.

In order to manually reset the reaction shooting target 10, the two side targets 14 and 16 are swing backward in a 90 degree arc from their forward released positions 26 back to their retracted positions 24, and the central target 12 is raised from its horizontal position 22 to its vertical position 20 so that the ears 36 reengage the notched arms 38, preventing the spring loaded mechanisms 34 from pushing the side targets 14 and 16 forward until the central target 12 is once again struck by a bullet and thereby caused to fall backward.

At the same time that the reaction shooting target 10 is manually reset, new pictures or images 42A, 42B, 42C, etc. can be attached to the central target and to the side targets 14 and 16 so the next time the central target 12 is struck by a bullet, a new set of images 42B, 42C, etc. will be presented to the shooter by the two side targets 14 and 16. The images 42B, 42C, etc. may include pictures of good guys and bad guys in various situations so that the shooter must quickly decide whether the images 42B, 42C, etc. presented on the targets 14 and 16 are friendly or unfriendly and whether the shooter should shoot the images 42B, 42C, etc. or not.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A reaction shooting target comprising:

a frame, a central target pivotally attached to said frame so that the central target pivots between a vertical in use position and a horizontal out of use position, two side targets pivotally attached to said frame so that each side target pivots between a retracted out of use position and a released in use position, spring loaded mechanisms biasing each side target forward to its released in use position, each side target provided with an arm that removably engages an associated ear on the central target so that the side targets are held in retracted positions by the ears until the central target pivots backward to its horizontal out of use position.

2. A reaction shooting target according to claim 1 wherein a variety of images are removably attachable to the side targets.

3. A reaction shooting target comprising:

a frame, a central target pivotally attached to said frame so that the central target pivots from a vertical in use position to a horizontal out of use position when the central target is struck by a bullet, two side targets pivotally secured to said frame by spring loaded mechanisms that bias the side targets toward a released in use position where the side targets are aligned in a single plane and face in the same direction, each of said side targets provided with a notched arm that removably engages an associated ear on the central target so that the side targets are held parallel to each other in their retracted out of use positions by the ears until the central target pivots backward to its horizontal out of use position and thus releases the notched arms and their associated side targets to swing to their released in use positions.

4. A reaction shooting target according to claim 3 wherein a variety of images are removably attachable to the side targets.

* * * * *